US008195067B2

(12) United States Patent
Sasaki et al.

(10) Patent No.: US 8,195,067 B2
(45) Date of Patent: Jun. 5, 2012

(54) HEATING APPARATUS AND IMAGE FORMING APPARATUS

(75) Inventors: Takanori Sasaki, Kanagawa (JP); Takashi Ohhashi, Kanagawa (JP); Kouichi Kimura, Kanagawa (JP); Keita Yano, Kanagawa (JP); Hiroshi Daigo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 129 days.

(21) Appl. No.: 12/796,111

(22) Filed: Jun. 8, 2010

(65) Prior Publication Data

US 2011/0142507 A1 Jun. 16, 2011

(30) Foreign Application Priority Data

Dec. 10, 2009 (JP) ..... 2009-280768

(51) Int. Cl.
*G03G 15/16* (2006.01)

(52) U.S. Cl. ..... 399/122

(58) Field of Classification Search ..... 399/33, 399/67, 122, 320, 307, 322, 327, 400, 329, 399/328, 124

See application file for complete search history.

(56) References Cited

U.S. PATENT DOCUMENTS

| | | | | |
|---|---|---|---|---|
| 6,078,765 | A * | 6/2000 | Takano et al. | 399/124 |
| 2004/0190958 | A1 * | 9/2004 | Matsumoto | 399/329 |
| 2007/0217839 | A1 * | 9/2007 | Moteki et al. | 399/329 |
| 2009/0180792 | A1 * | 7/2009 | Hayamizu | 399/67 |
| 2009/0226200 | A1 | 9/2009 | Ando | |

FOREIGN PATENT DOCUMENTS

JP A-2009-210792 9/2009

* cited by examiner

*Primary Examiner* — Kiho Kim
(74) *Attorney, Agent, or Firm* — Oliff & Berridge, PLC

(57) ABSTRACT

A heating apparatus of the present invention includes a press member that undergoes driven rotation by contacting a heating member that rotates, the press member conveying a recording medium while nipping the recording medium between the press member and the heating member; a contact and separation mechanism that contacts the press member against the heating member and separates the press member away from the heating member; and a drive mechanism that rotationally drives the press member when the press member is separated from the heating member by the contact and separation mechanism.

7 Claims, 10 Drawing Sheets

HEATING APPARATUS AND IMAGE FORMING APPARATUS

CROSS-REFERENCE TO RELATED APPLICATION

This application is based on and claims priority under 35 USC 119 from Japanese Patent Application No. 2009-280768 filed on Dec. 10, 2009.

BACKGROUND

1. Technical Field

The present invention relates to a heating apparatus and an image forming apparatus.

2. Related Art

It is known to provide a heating apparatus, having a heating member and a press roll, configured to be capable of contacting against the heating member and separating away from the heating member.

SUMMARY

A heating apparatus of a first aspect of the present invention includes: a press member that undergoes driven rotation by contacting a heating member that rotates, the press member conveying a recording medium while nipping the recording medium between the press member and the heating member; a contact and separation mechanism that contacts the press member against the heating member and separates the press member away from the heating member; and a drive mechanism that rotationally drives the press member when the press member is separated from the heating member by the contact and separation mechanism.

BRIEF DESCRIPTION OF THE DRAWINGS

Exemplary embodiments of the present invention will be described in detail based on the following figures, wherein.

DETAILED DESCRIPTION

Figure 1:
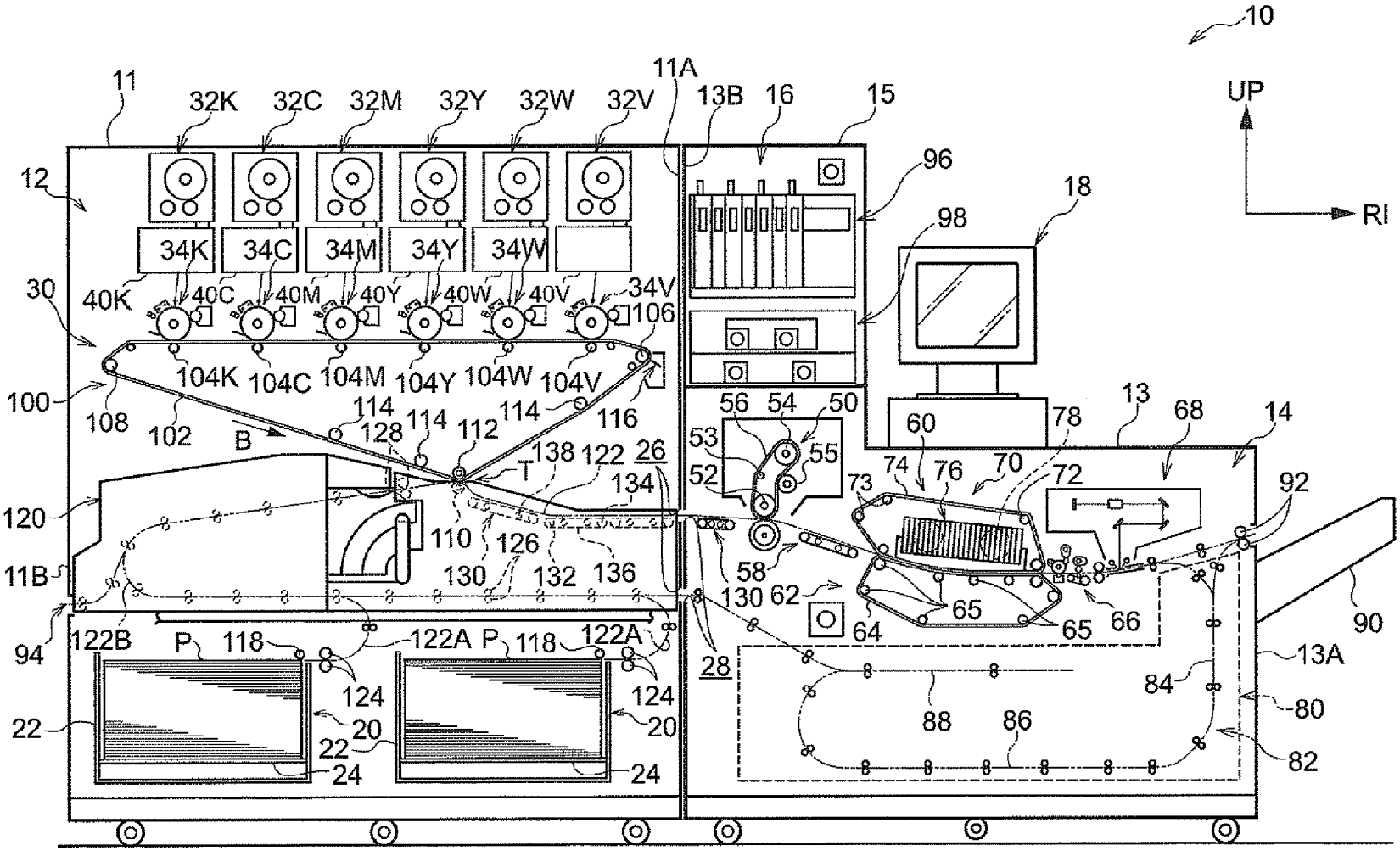
FIG. 1 is a schematic configuration diagram showing an image forming apparatus according to a present exemplary embodiment overall.

Detailed explanation follows regarding an exemplary embodiment according to the present invention, based on an exemplary embodiment shown in the drawings. For ease of explanation, the up direction is shown by arrow UP, the right direction shown by arrow RI, and the front direction shown by arrow FR, and in each of the drawings, when each of the arrows are shown these represent the up-down, left-right, and front-rear according to the directions shown by these arrows. Further, the conveying direction upstream side and conveying direction downstream side of a recording medium, which is a sheet shaped member, are sometimes referred to below simply as "upstream side" and "downstream side".

As shown in FIG. 1, an image fowling apparatus 10 according to the present exemplary embodiment is configured by a first processing section 12, where the processes up to the process of secondary transfer of developer images (referred to below as "toner images") onto recording paper P, serving as an example of the recording medium, and conveyance are performed, and a second processing section 14, where processing for processes onwards from fixing toner images onto the recording paper P, which has arrived conveyed from the first processing section 12, are performed, integrally connected together (enabling the recording paper P to be passed across therebetween) in the left-right transverse direction (horizontal direction).

The first processing section 12 is incorporated within a first casing body 11, and the second processing section 14 is incorporated within a second casing body 13 that is attachable and detachable to and from the first casing body 11. A third casing body 15, is disposed on the second casing body 13 adjacent to the first casing body 11 with a control section 16, serving as an example of control means, incorporated within the third casing body 15. Further, a display device 18 is disposed on the second casing body 13 at the side (downstream side) of the third casing body 15.

The first processing section 12 is equipped with: a paper feed section 20 accommodating the recording paper P; a conveying section 120 that conveys the recording paper P; a transfer section 100 that transfers toner images onto the recording paper P; and an image forming section 30 that forms toner images for primary transfer at the transfer section 100. Specifically, first, two individual paper feed cassettes 22 respectively accommodating the recording paper P provided at a lower portion in the first casing body 11, in a row along the left-right transverse direction.

The paper feed cassettes 22 are capable of being pulled out towards the front side from within the first casing body 11, and when the paper feed cassette 22 is pulled out from within the first casing body 11, bottom plates 24 provided in the respective paper feed cassettes 22 lower, such that recording paper P can be filled by placing the recording paper P on the bottom plates 24. Note that configuration is made such that the bottom plate 24 rises when the paper feed cassette 22 is mounted in the first casing body 11.

The conveying section 120 is disposed above the paper feed cassettes 22. The transfer section 100 is disposed above the conveying section 120, and the image forming section 30 is disposed above the transfer section 100. The image forming section 30, the transfer section 100, and the conveying section 120 are described below. Openings 26 are formed in a right side face 11A of the first casing body 11, facing the second casing body 13, for conveying recording paper P out from an upper portion and conveying recording paper P in from a bottom portion.

The second processing section 14 is an example of a fixing apparatus for fixing toner images, secondary transferred onto the recording paper P by the transfer section 100, onto the recording paper P. The second processing section 14 is equipped with a fixing section 50, a cooling section 60 for cooling the recording paper P onto which a toner image has been fixed by the fixing section 50, and an inverting section 80 for inverting the recording paper P and conveying the recording paper P once more into the first processing section 12 when performing double-side printing.

Openings 28 are formed in a left wall face 13B of the second casing body 13, facing the right side face 11A of the first casing body 11, and the recording paper P is conveyed in from an upper portion and the recording paper P is conveyed out from a bottom portion. The openings 28 face the openings 26. The fixing section 50 is disposed capable of fixing toner images onto the recording paper P conveyed through the opening 28 on the upper side. Details regarding the fixing section 50 are described below.

The cooling section 60 is disposed at the side (downstream side) of the fixing section 50. The cooling section 60 is configured on either side of a conveying path 122 (described below) with an absorption device 70 provided on the upper side, in contact with the recording paper P and absorbing heat from the recording paper P, and a pressing device 62 provided at the lower side, pressing the conveyed recording paper P against the absorption device 70.

The absorption device 70 includes an endless shaped absorption belt 74 entrained around a drive roll 72 for transmitting driving force, and plural tension rolls 73. A heat sink 76 is present inside the absorption belt 74 of the absorption device 70, contacting the absorption belt 74 along a plane shape, for dissipating the heat absorbed by the absorption belt 74. Two individual suction fans 78 are provided in a row at the back face side of the second casing body 13 (into the paper in the drawing), for externally discharging hot air that has taken the heat from the heat sink 76.

Further, the pressing device 62 has an endless shaped press belt 64, in contact with the conveyed recording paper P and pressing the recording paper P towards the absorption device 70. The press belt 64 is tensioned around plural individual tension rolls 65, to as to be rotatably supported. By the cooling section 60 configured in such a manner, the recording paper P that has arrived from the fixing section 50 is cooled.

Further, a de-curl processing section 66 that corrects curl of the recording paper P (flattens the recording paper P) is disposed at the side (downstream side) of the cooling section 60. An inline sensor section 68 is disposed at the side (downstream side) of the de-curl processing section 66, for optically detecting, for example, density defects, image defects, image alignment defects, and the like in toner images fixed to the recording paper P.

Output rolls 92 are provided at the side (downstream side) of the inline sensor section 68 for discharging the recording paper P, fowled with an image on one side, to an output section (output tray) 90 mounted to a right wall face 13A of the second casing body 13, such that the recording paper P is output onto the output section 90 by the output rolls 92 when performing single-sided printing.

Further, the inverting section 80 is disposed below the fixing section 50, the cooling section 60, the de-curl processing section 66, and the inline sensor section 68. Namely, when forming images on both sides of the recording paper P, the recording paper P conveyed out from the inline sensor section 68 is conveyed towards the inverting section 80. More precisely, the recording paper P is guided by a switching member, not shown in the figures, towards an inverting path 82 provided in the inverting section 80.

The inverting path 82 is equipped with a branch path 84 that branches from the conveying path 122 (described below) in the second processing section 14, a paper conveying path 86 that conveys the recording paper P conveyed along the branch path 84 towards the first processing section 12 side, and a reverse path 88 that returns the recording paper P conveyed along the paper conveying path 86 back in the opposite direction, so as to invert the front and reverse faces of the recording paper P and switch-back convey the recording paper P.

Due to this configuration, the recording paper P switch-back conveyed by the reverse path 88 is conveyed, through the lower opening 28 and opening 26, into the first processing section 12, and re-fed towards the conveying path 122 of the conveying section 120. Due thereto, the recording paper P is conveyed once more to a transfer point T, which is a nip portion between a secondary transfer roll 110 and a back-up roll 112, described below.

Note that a feeder section 94 is provided in a left wall face 11B of the first casing body 11, such that recording paper P can be fed from a large volume feed cassette (not shown in the figures) provided adjacent to the left wall face 11B. Further, the control section 16 is equipped with an image signal processing section 96 for performing processing on image data transmitted from a computer, not shown in the figures, and a power source section 98 that supplies power to each of the sections.

Next, explanation is given regarding the image forming section 30. The image forming apparatus 10 according to the present exemplary embodiment is configured capable of forming a full color image, or a black and white image, and is provided with toner cartridges 32V, 32W, 32Y, 32M, 32C, and 32K, containing respective toners of each of a first special color (V), a second special color (W), yellow (Y), magenta (M), cyan (C) and black (K), replaceably provided in a row along the left-right transverse direction (horizontal direction).

Note that the first special color and the second special color are suitably selected form special colors (including transparent) other than yellow, magenta, cyan, and black. Further, in the following explanation, when discrimination is made between V, W, Y, M, C, and K the respective letters V, W, Y, M, C, and K are appended as suffices to numerals, however when discrimination is not made between V, W, Y, M, C, and K then V, W, Y, M, C, and K are omitted.

Six image forming units 34 are provided beneath the toner cartridges 32 in a row along the left-right transverse direction (horizontal direction), so as to correspond to each of the respective toner cartridges 32. A light-exposure unit 40 is provided between each of the toner cartridges 32 and the image forming units 34.

The light-exposure unit 40 provided to each of the image forming units 34 acquires image data that has been subjected to processing by the image signal processing section 96 mentioned above. Further, the light-exposure units 40 are configured so as to modulate respective semiconductor lasers (not shown in the figures) according to color matter gradation data, so as to emit exposure light L from each of the semiconductor lasers according to the color matter gradation data. More precisely, the light-exposure units 40 are configured such that exposure light L corresponding to each color is illuminated onto surfaces of photoreceptors 36 (see FIG. 2), described below, so as to form electrostatic latent images on the photoreceptors 36.

Figure 2:
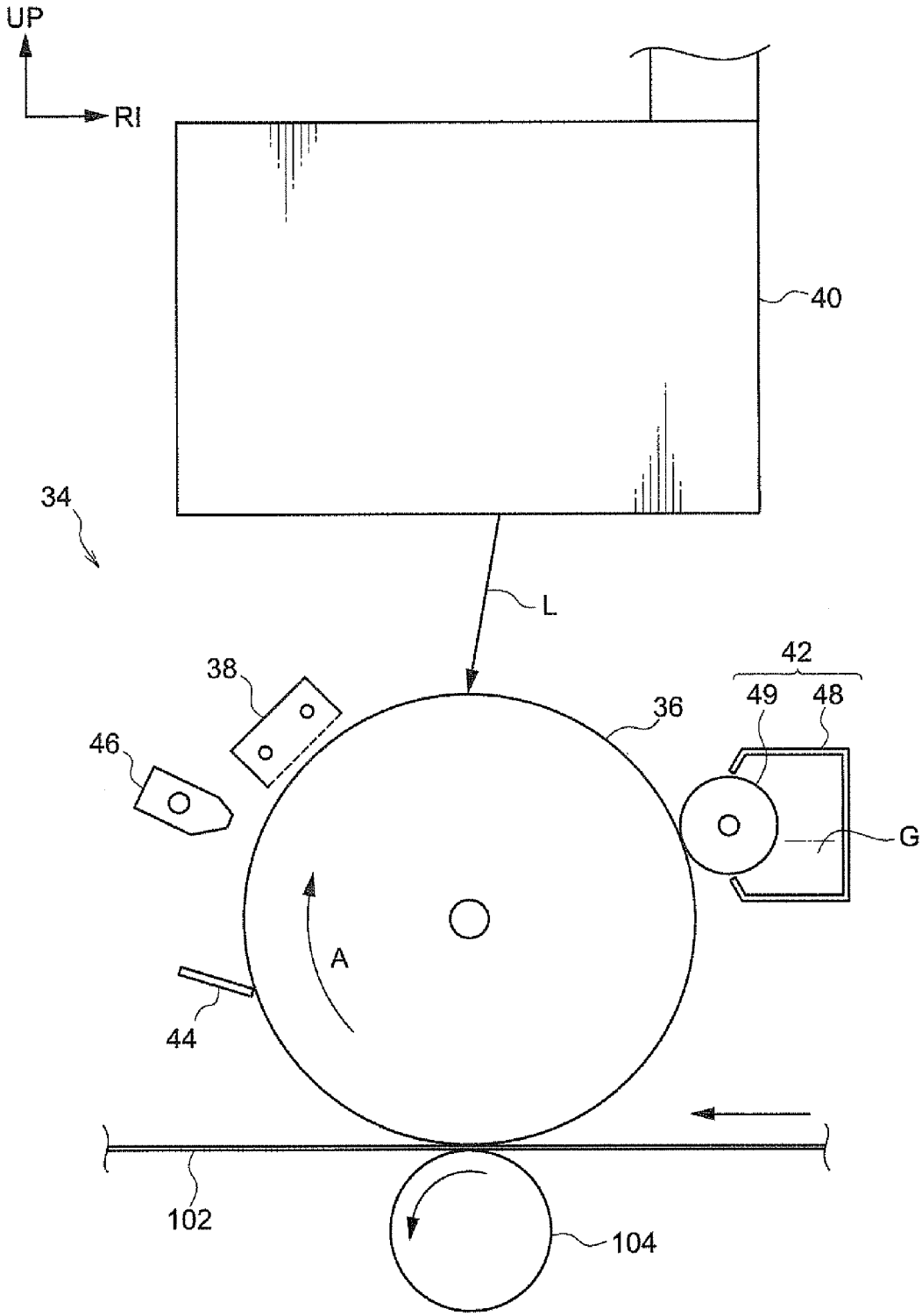
FIG. 2 is schematic configuration diagram showing an image forming section of an image forming apparatus according to the present exemplary embodiment.

As shown in FIG. 2, the image forming units 34 are each equipped with the photoreceptor 36 rotatably driven in the direction of arrow A (clockwise in the figure). Around the periphery of the photoreceptor 36 are provided: a corona discharge method (non-contact charging method) scorotron charger 38, serving as a charging device that uniformly charges the photoreceptor 36; a developer device 42 that develops the electrostatic latent image, formed on the photoreceptor 36 by the exposure light L emitted by the light-exposure unit 40, with developer (toner) of each of the colors; a cleaning blade 44, serving as a cleaning device that cleans the surface of the photoreceptor 36 after transfer; and an erasure lamp 46, serving as a charge removing device that illuminates light onto the surface of the photoreceptor 36 after transfer, and removes charge.

Note that the scorotron charger 38, the developer device 42, the cleaning blade 44, and the erasure lamp 46 are disposed facing the surface of the photoreceptor 36, in this sequence from the upstream side to the downstream side in the rotation direction of the photoreceptor 36.

Further, the developer device 42 is disposed at the side (the right hand side in the figure) of the image forming unit 34. The developer device 42 is configured including a developer containing member 48 filled with a developer G containing toner, and a developer roll 49 that moves the toner filled in the developer containing member 48 onto the surface of the photoreceptor 36. The developer containing member 48 is connected through a toner supply path (not shown in the figures) to the toner cartridge 32 (see FIG. 1), so as to supply toner from the toner cartridge 32.

Next, explanation follows regarding the transfer section 100. As shown in FIG. 1, the transfer section 100 is provided beneath the image forming units 34. The transfer section 100 is configured including an endless shaped intermediate transfer belt 102 in contact with each of the photoreceptors 36, and six primary transfer rolls 104, serving as primary transfer members, disposed within the intermediate transfer belt 102 and superimposing and transferring the toner images formed on each of the respective photoreceptors 36 onto the intermediate transfer belt 102.

Further, the intermediate transfer belt 102 is entrained, with a given tension, between a driven roll 106 driven by a motor, not shown in the figures, tension imparting rolls 108 that regulate the tension of the intermediate transfer belt 102, the back-up roll 112 disposed facing the secondary transfer roll 110, described below, and plural individual tensioning rolls 114, such that the intermediate transfer belt 102 moves circulating in the direction of arrow B of FIG. 1 (anti-clockwise in the figure) due to the driven roll 106.

More precisely, each of the primary transfer rolls 104 is disposed facing a respective photoreceptor 36 of the image forming units 34, with the intermediate transfer belt 102 disposed therebetween. The primary transfer rolls 104 are applied with a transfer bias voltage of opposite polarity to that of the toner polarity by a charging unit (not shown in the figures). Due to such a configuration, the toner image formed on each of the photoreceptors 36 is transferred onto the intermediate transfer belt 102.

A cleaning blade 116 is provided at the opposite side of the intermediate transfer belt 102 to that of the driven roll 106, with the intermediate transfer belt 102 disposed therebetween, and the leading end portion of the cleaning blade 116 in contact with the intermediate transfer belt 102. The cleaning blade 116 removes, for example, remaining toner, paper dust, or the like on the circulating intermediate transfer belt 102.

Next, explanation follows regarding the conveying section 120 in the first processing section 12. A feeder roll 118 is provided at one side above an end of the paper feed cassette 22 (the right hand side in the figure) for feeding recording paper P out from the paper feed cassette 22 towards the conveying path 122. The feeder roll 118 makes contact with the uppermost positioned recording paper P placed in the raised bottom plate 24.

A pair of separation rolls 124 is provided at the downstream side of the feeder roll 118 for preventing multi-feeding of the recording paper P. Plural pairs of conveying rolls 126 are provided at the downstream side of the separation rolls 124 for conveying the recording paper P to the downstream side.

The conveying path 122 of the conveying section 120 provided between the paper feed section 20 (the paper feed cassette 22) and the transfer section 100 (intermediate transfer belt 102) returns the recording paper P fed out from the paper feed cassette 22 back towards the left direction shown in the figure at a first return section 122A. Furthermore, the conveying path 122 is such that the recording paper P is returned back towards the right direction shown in the figure at a second return section 122B, and feeds the recording paper P out towards the transfer point T, which is the nip portion between the secondary transfer roll 110 and the back-up roll 112.

A aligner (not shown in the figures) is provided between the second return section 122B and the transfer point T, for correcting, for example, the orientation or the like of the conveyed recording paper P. A position matching roll 128 is provided between the aligner and the transfer point T, for matching the movement timing of the toner image on the intermediate transfer belt 102 to the conveying timing of the recording paper P.

The secondary transfer roll 110, serving as a secondary transfer member and provided at the downstream side of the position matching roll 128, is applied with a transfer bias voltage of opposite polarity to the toner polarity by a charging unit (not shown in the figures). Due thereto, configuration is such that the toner images of each of the colors superimposed and transferred onto the intermediate transfer belt 102 are secondarily transferred by the secondary transfer roll 110 onto the arriving recording paper P conveyed along the conveying path 122. Note that the above described feeder section 94 combines flow at the second return section 122B of the conveying path 122.

Plural individual vacuum conveying devices 130 are provided at the downstream side of the transfer point T, for conveying the recording paper P, onto which the toner image has been transferred, towards and into the second processing section 14. Each of the vacuum conveying devices 130 is equipped with a drive roll 132 that rotationally drives, a rotatably supported following roll 134, and plural strands of belt members 136 entrained around the drive roll 132 and the following roll 134.

Plural individual through holes (not shown in the figures) are provided over the entire surface of the belt members 136. A suction fan 138 is disposed at a back wall portion side (into the paper in the figures) of the first casing body 11 and suctions air from the through holes towards the inside of the belt members 136.

Due to such a configuration, the back face (non-imaged face) of the recording paper P, where there is no toner image formed, is suctioned onto the belt members 136, and the drive roll 132 is rotationally driven, rotating the belt members 136. Due thereto, the recording paper P is conveyed further to the downstream side, namely towards the vacuum conveying devices 130 of the second processing section 14.

Note that the vacuum conveying devices 130 of the second processing section 14 are also of a similar configuration to the vacuum conveying devices 130 of the first processing section 12. The conveying path 122 in the second processing section 14 is connected to the conveying path 122 in the conveying section 120 of the first processing section 12.

Next, explanation follows regarding the image forming process (operation). Image data that has been subjected to image processing by the image signal processing section 96 is converted into color matter gradation data for each of the colors, and sequentially output to each of the light-exposure units 40. In each of the light-exposure units 40, each of the exposure lights L is emitted according the color matter gradation data of each of the colors, and scanning exposure is performed on the respective photoreceptor 36 that has been charged by the scorotron charger 38, forming an electrostatic latent image.

The electrostatic latent images formed on the photoreceptors 36 are actualized (developed) by the developer devices 42 as toner images (developer images) of each of the colors, the first special color (V), the second special color (W), yellow (Y), magenta (M), cyan (C) and black (K), respectively.

The toner images of each of the colors, formed on the respective photoreceptors 36 of the respective image forming units 34V, 34W, 34Y, 34M, 34C, and 34K, are sequentially superimposed and transferred onto the intermediate transfer belt 102 by the six primary transfer rolls 104V, 104W, 104Y, 104M, 104C, and 104K.

The toner images of each of the colors, superimposed and transferred onto the intermediate transfer belt 102, are secondarily transferred by the secondary transfer roll 110 onto the recording paper P that has arrived, conveyed from the paper feed section 20 (the paper feed cassette 22). The recording paper P onto which the toner images have been transferred are conveyed towards the fixing section 50 by the vacuum conveying devices 130.

The recording paper P conveyed to the fixing section 50 is heated and pressed by the fixing section 50, such that the toner images of each of the colors transferred onto the recording paper P are fixed. Then, the recording paper P, onto which the toner images of each of the colors have been fixed, passes through the cooling section 60, and after cooling thereby is fed into the de-curl processing section 66, where curl generated in the recording paper P is corrected. After the curl-corrected recording paper P has been subjected to detection for image defects and the like by the inline sensor section 68, the recording paper P is then output to the output section 90 by the output rolls 92.

Note that when an image is to be formed on the reverse face not currently formed with an image (when double-sided printing), the recording paper P, after passing through the inline sensor section 68, is fed out to the inverting section 80. The recording paper P fed to the inverting section 80 passes through the inverting path 82, is inverted, is fed once more into the first processing section 12, and a toner image is formed on the reverse face by the procedures described above.

Figure 3:
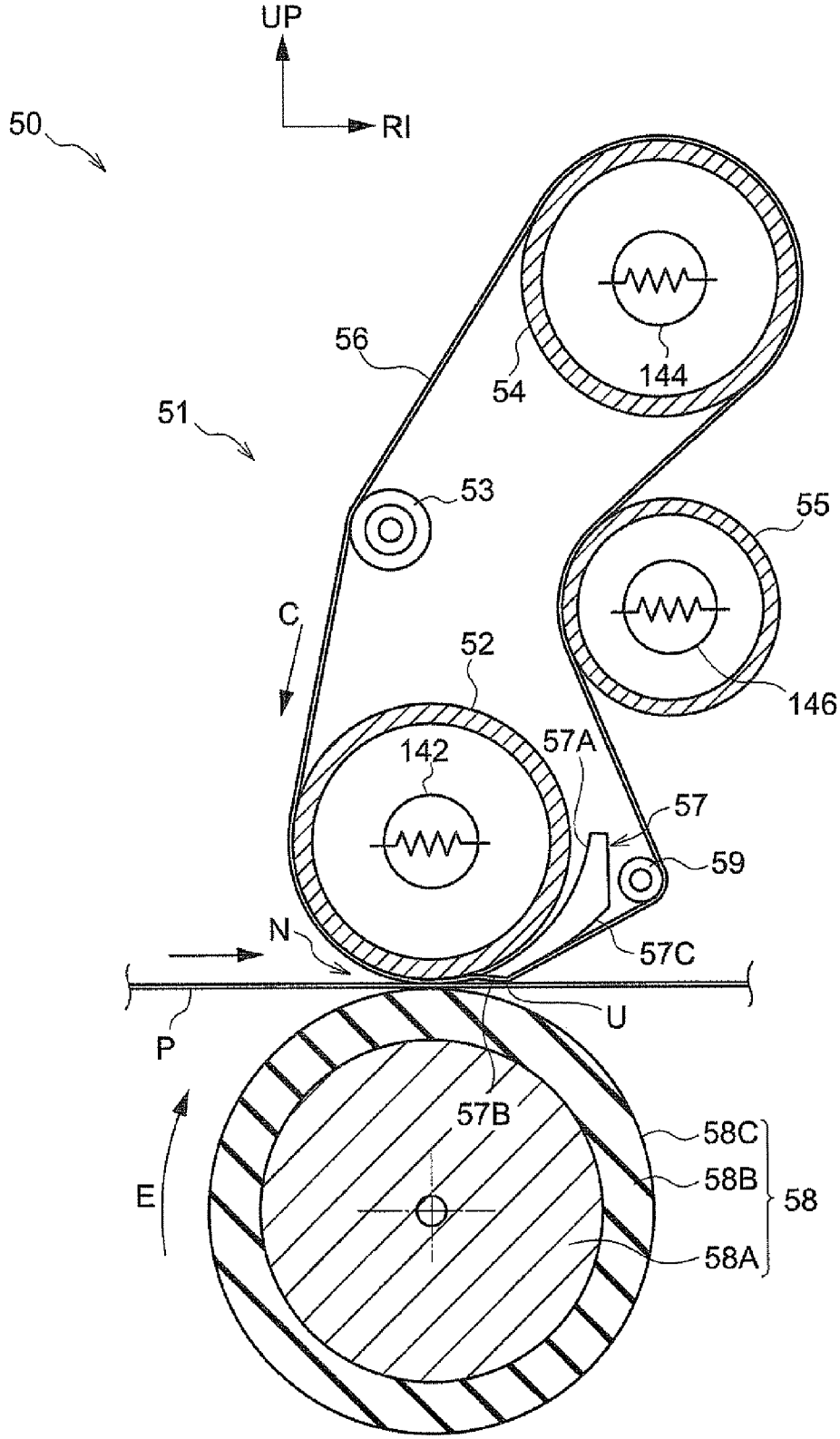
FIG. 3 is a schematic configuration diagram showing a fixing section having a heating apparatus according to the present exemplary embodiment.
Figure 4:
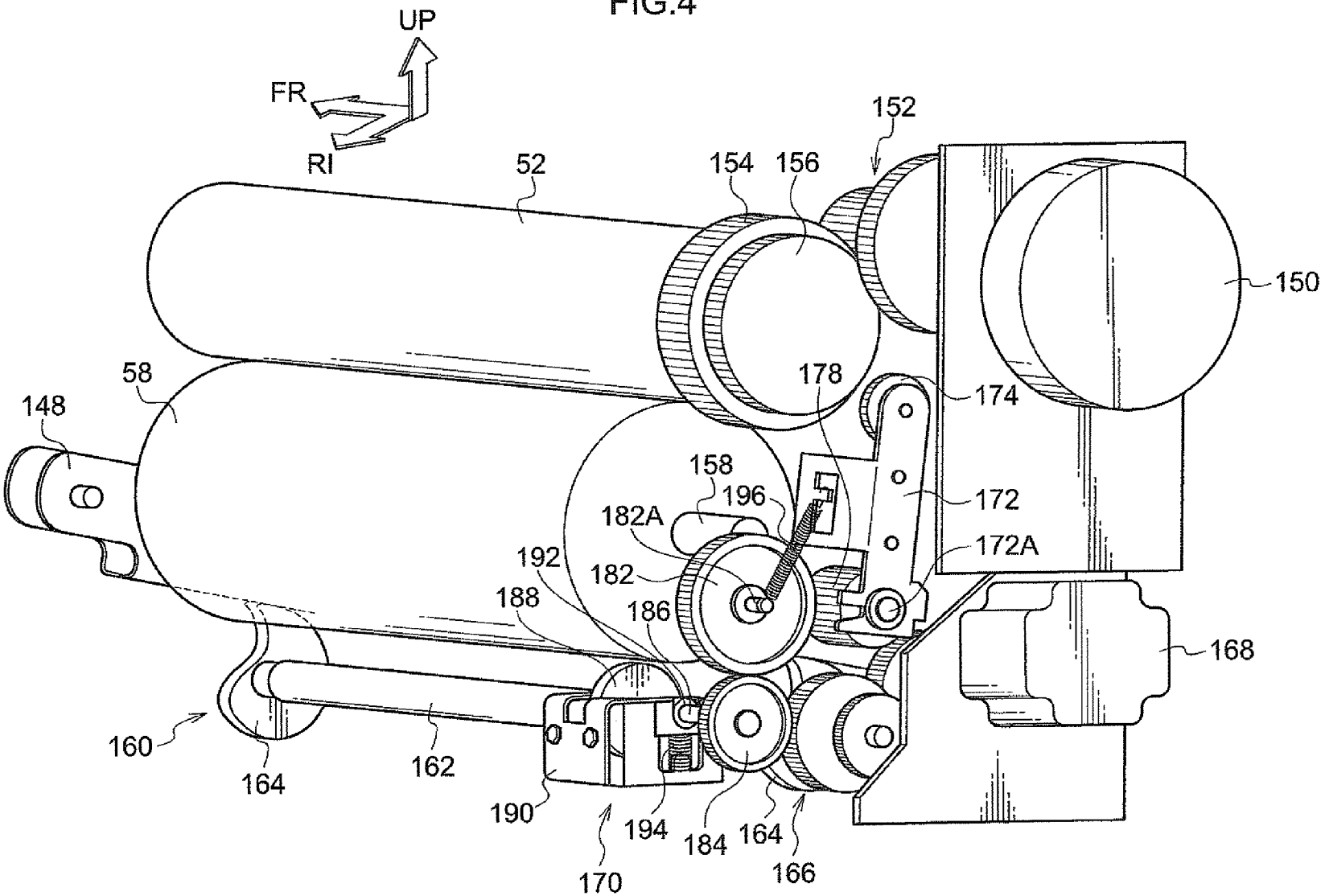
FIG. 4 is a schematic perspective view showing a press roll and a heater roll according to the present exemplary embodiment.
Figure 5:
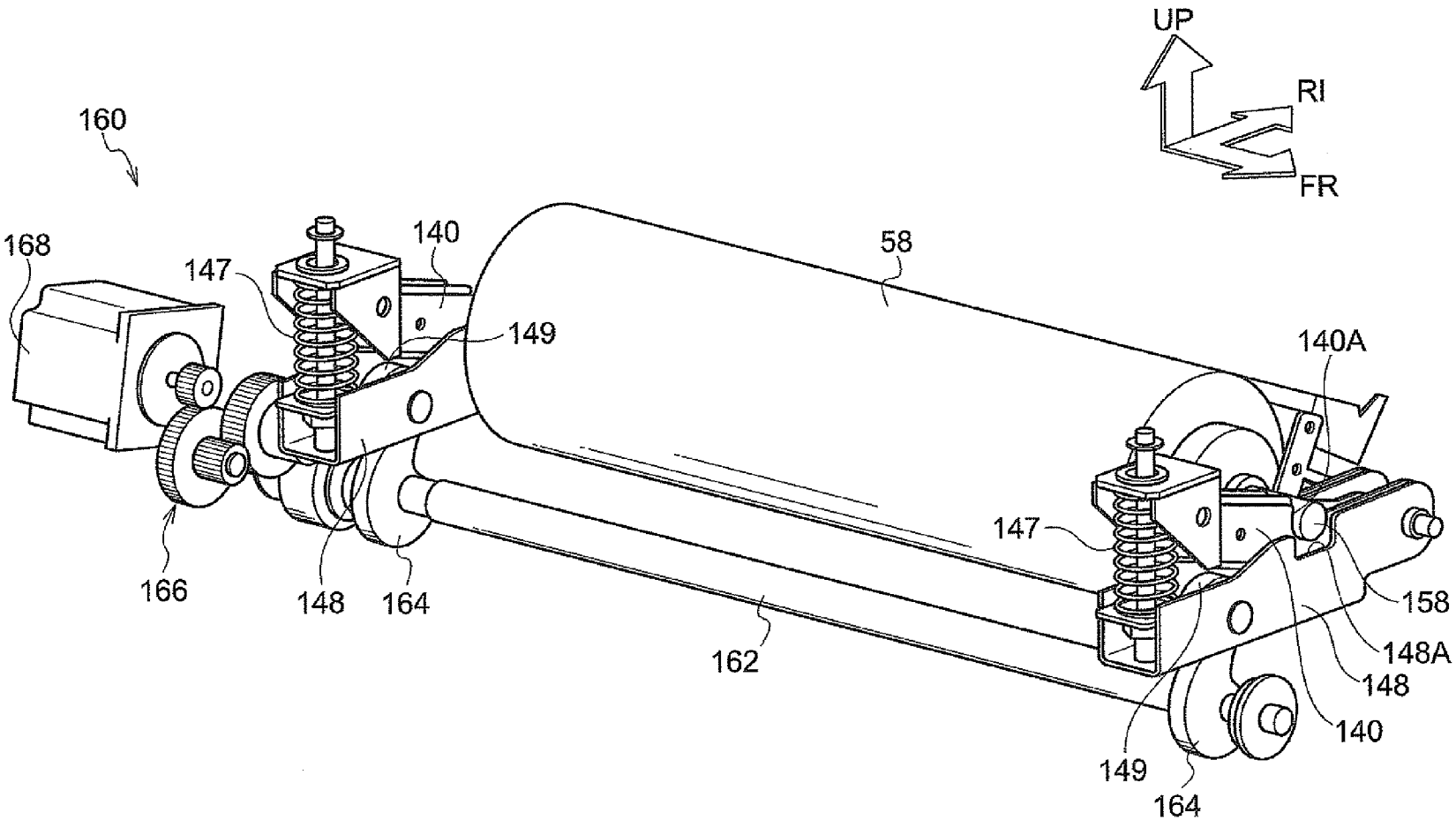
FIG. 5 is schematic perspective view showing a contact and separation mechanism of a press roll according to the present exemplary embodiment.

Detailed explanation follows regarding the configuration of the fixing section 50 (heating apparatus) in the image forming apparatus 10 configured as described above. As shown in FIG. 3, the fixing section 50 is configured including a fixing belt module 51 equipped with a fixing belt 56, as an example of a heating member, and a press roll 58, as an example of a press member, disposed so as to be capable of press contact (contact) with, and separation from, the fixing belt module 51.

The region where the fixing belt 56 (the fixing belt module 51) and the press roll 58 are in press contact is referred to as nip portion N, and in the nip portion N the recording paper P is pressed and heated such that toner images are fixed to the recording paper P. Note that the fixing belt 56 is omitted in FIG. 4 to FIG. 10.

As shown in FIG. 3, the fixing belt module 51 is equipped with: the endless shaped fixing belt 56; a heater roll 52, around which the fixing belt 56 is entrained on the press roll 58 side of the heater roll 52 that rotates due to rotational driving force transmitted from a drive motor 150 (see FIG. 4), serving as an example of a drive source, through a gear train 152 and a gear 154; a support roll 54 that entrains the fixing belt 56 from the inside at a different position (upper position) to that of the heater roll 52; a support roll 55 that is disposed at the outside of the fixing belt 56 and determines the circulatory path of the fixing belt 56; and a posture correction roll 53 that is disposed at the inside of the fixing belt 56 and corrects the posture of the fixing belt 56.

A separation pad 57, which separates the fixing belt 56 from the outer peripheral face of the heater roll 52, is provided at a region at the downstream side in the nip portion N, which is the region where the fixing belt module 51 and the press roll 58 are in press contact, disposed at the inside of the fixing belt 56 in a position in the vicinity of the heater roll 52. A support roll 59 is provided at the downstream side of the nip portion N, entraining the fixing belt 56.

The heater roll 52 is a hard roll with a protection layer formed on the surface of a circular cylindrical shaped metal core, formed from aluminum, in order to prevent metal abrasion. The protection layer of the hard roll is, for example, a fluorine resin covering film of 200 μm thickness. Note that a halogen heater 142 is provided within the heater roll 52, as an example of a heat source.

Further, the support roll 54 is a circular cylindrical shaped roll formed from aluminum. A halogen heater 144 is disposed within the support roll 54, as an example of a heat source, such that the fixing belt 56 is heated from the inner peripheral side thereof. Spring members (not shown in the figures) are disposed at portions at both end of the support roll 54, pressing the support roll 54 towards the outside of the entrained fixing belt 56.

The support roll 55 is a circular cylindrical shaped roll formed from aluminum. A release layer is formed on the surface of the support roll 55, for example from a fluoro resin at a thickness of 20 μm. This release layer is formed in order to prevent build up on the support roll 55 of small amounts of off-set toner and paper dust from the outer peripheral face of the fixing belt 56.

A halogen heater 146 is disposed within the support roll 55, as an example of a heat source, such that the fixing belt 56 is heated from the outer peripheral side thereof. Namely, the fixing section 50 according to the present exemplary embodiment is configured such that the fixing belt 56 is heated by the heater roll 52, support roll 54 and the support roll 55.

The posture correction roll 53 is a circular cylindrical shaped roll formed from aluminum. An edge position measurement mechanism (not shown in the figures) is disposed in the vicinity of the posture correction roll 53 for measuring the edge position of the fixing belt 56. An axial displacement mechanism (not shown in the figures) is disposed to the posture correction roll 53, for displacing the contact position to the fixing belt 56 in width direction (axial direction), which is orthogonal to the movement direction, according to the measurement results of the edge position measurement mechanism, configuring so as to control snaking of the fixing belt 56.

Further, the separation pad 57 is a block shaped member having a length that corresponds to the length in the axial direction of the heater roll 52, and, for example, is formed as a rigid body from a ferric metal, from a resin, or the like. The cross-sectional shape of the separation pad 57 forms substantially a crescent shape, equipped with an internal face 57A that curves around against the heater roll 52, a press face 57B that presses the fixing belt 56 towards the press roll 58, and an outside face 57C that has a predetermined angle to the press face 57B and kinks the fixing belt 56.

Further, configuration is made such that the press face 57B of the separation pad 57 and the outside face 57C thereof configure a corner portion U. The corner portion U is such that the fixing belt 56, pressed thereon by the press roll 58, is kinked. When the fixing belt 56 is kinked in this manner, the leading end of the recording paper P becomes readily separated from the fixing belt 56 when passing the corner portion U.

The press roll 58 has a circular cylindrical shaped roll 58A formed from aluminum as a base body, configured with a resilient layer 58B, formed from a silicon rubber, and a separation layer (referred to below as "surface portion") 58C formed from a fluoro resin at a film thickness of 100 μm, with the resilient layer 5813 and the surface portion 58C layered in sequence from the outside of the base body (roll 58A).

The press roll 58 is one that is rotationally supported, and is configured so as to be able to make press contact with, and separate from, the fixing belt 56 wound around the heater roll 52, by means of a contact and separation mechanism 160, described below. The press roll 58, by press contact with the fixing belt 56 due to the contact and separation mechanism 160, performs rotation in the direction of arrow E, following the circulatory movement of the fixing belt 56 in the direction of arrow C.

As shown in FIG. 4 to FIG. 6A and FIG. 68, the contact and separation mechanism 160 of the press roll 58 raises and lowers the press roll 58 to adopt a press-contact position (see FIG. 6B), where press-contact is made with the fixing belt module 51 (the fixing belt 56), and a separated position (see FIG. 6A), where separated from the fixing belt module 51 (the fixing belt 56).

Namely, both axial direction end portions of a rotation shaft 158 of the press roll 58 are respectively supported from below by being inserted into rectangular shaped cut-out portions 140A formed at substantially central portions in the length direction of respective support plates 140. Further, support members 148, of substantially a U-shape in cross-section open at the top side and capable of accommodating the support plates 140, are respectively provided below each of the support plates 140.

First end side of each of the support plates 140 is rotatable supported at first end side of the respective support member 148, and the first end side of each of the support members 148 is, for example, rotatably supported by a frame, not shown in the figures. A resilient member 147, such as, for example, a compression coil spring or the like, is provided between the other end side of each of the support plates 140 and the other end side of each of the support members 148, so as to set a press-contact load of the press roll 58 against the fixing belt module 51 (the fixing belt 56).

Further, rectangular shaped cut-out portions 148A are formed in a substantially central portion in the length direction of edge portions on the open side (the top side) of each of the support members 148, permitting displacement of portions at both ends of the rotation shaft 158 supported in the cut-out portions 140A of each of the support plates 140. Support rolls 149 are respectively rotatably provided further towards the other end side of each of the support members 148 than the cut-out portions 148A.

Cam plates 164, fixed to a rotation shaft 162 provided with the same axial direction to that of the rotation shaft 158 of the press roll 58, are respectively disposed below each of the support rolls 149. The cam face of each of the cam plates 164 contacts the peripheral face of the respective support roll 149, so as to support each of the support rolls 149 from below. Due to rotational driving force transmitted from a drive motor 168 via a gear train 166, the rotation shaft 162 of the cam plates 164 rotates in a first direction (the direction of arrow D shown in FIG. 6A and FIG. 6B) and a second direction (the opposite direction to the direction of arrow D).

Figure 6A:
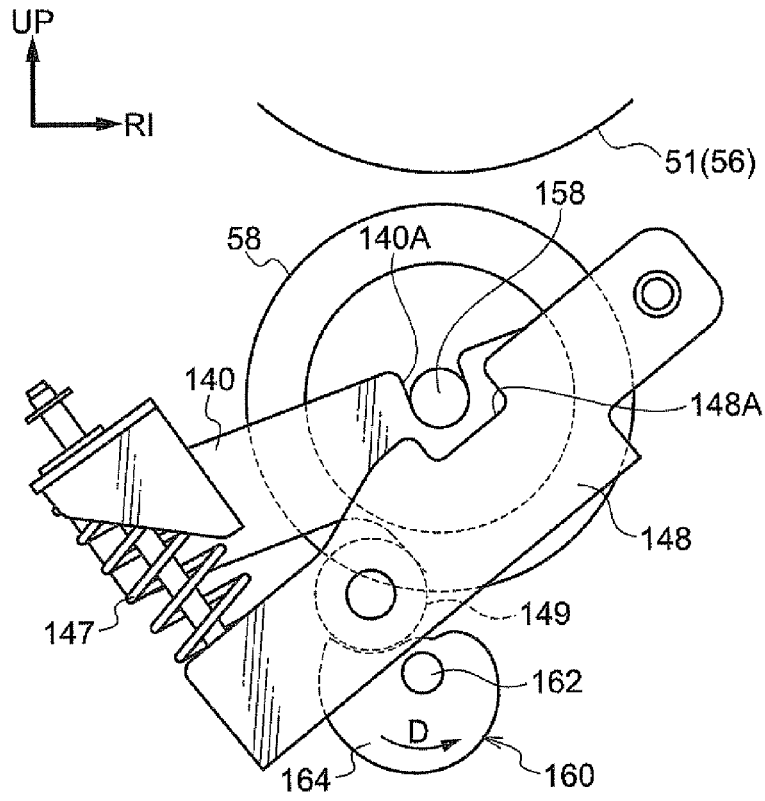
FIG. 6A is an explanatory diagram showing a state when the press roll has been separated by the contact and separation mechanism.
Figure 6B:
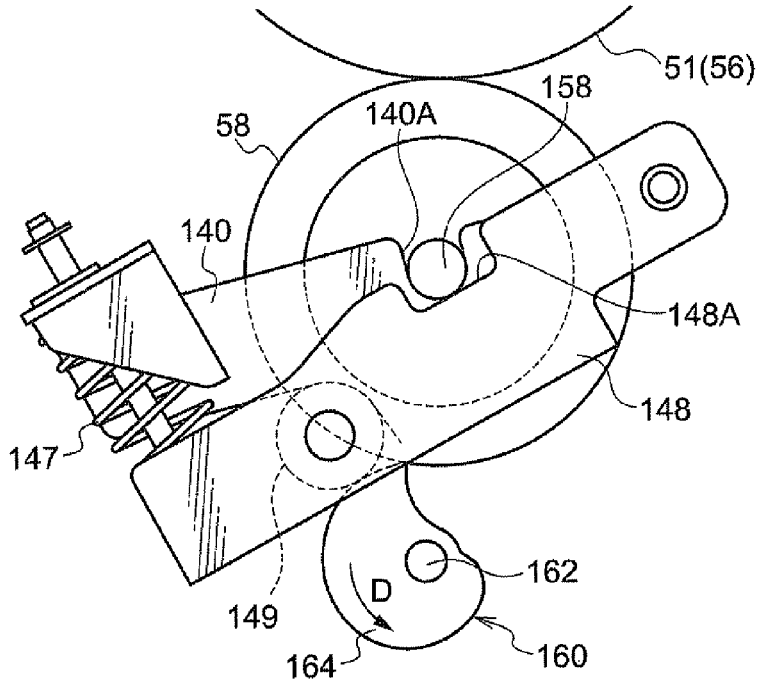
FIG. 6B is an explanatory diagram showing a state when the press roll is in press-contact due to the contact and separation mechanism.
Figure 7:
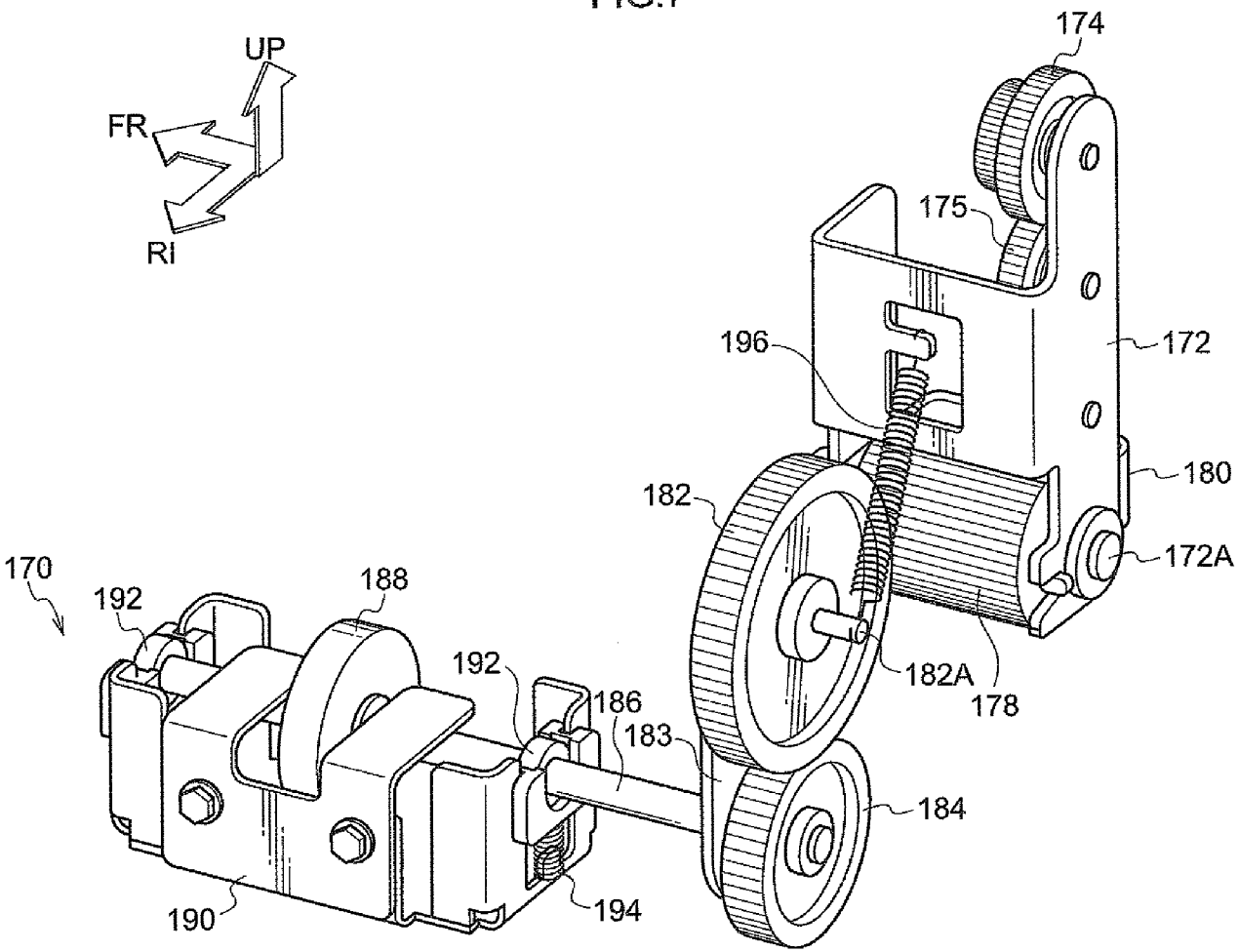
FIG. 7 is a schematic perspective view showing a drive mechanism according to the present exemplary embodiment.

Consequently, the rotation shaft 162 rotates in the first direction (the direction of arrow D) due to rotational drive force transmitted from the drive motor 168 via the gear train 166. Due to each of the cam plates 164 fixed to the rotation shaft 162 pushing up the support rolls 149 as they rotate, as shown in FIG. 6B, each of the support members 148 and each of the support plates 140 are raised, and both end portions of the rotation shaft 158 of the press roll 58, supported by the cut-out portions 140A, are pushed up. Due thereto, the surface portion 58C of the press roll 58 makes press-contact with the fixing belt module 51 (the fixing belt 56).

However, when the rotation shaft 162 rotates in the second direction (the opposite direction to the direction of arrow D) due to the rotational drive force transmitted from the drive motor 168 via the gear train 166, releasing pressing of each of the cam plates 164 up on each of the support rolls 149, and each of the support members 148 and each of the support plates 140 moves down under gravity while supporting the rotation shaft 158 of the press roll 58. Due thereto, as shown in FIG. 6A, the surface portion 58C of the press roll 58 separates from the fixing belt module 51 (the fixing belt 56).

Note that the rotational operation of the rotation shaft 162 of the contact and separation mechanism 160 in the first direction and in the second direction is controlled by the control section 16. In other words, press-contact and separation operations of the press roll 58 (the surface portion 58C) to the fixing belt module 51 (the fixing belt 56) are controlled by the control section 16.

Further, configuration is made such that the press roll 58 rotates (idles) when in the separated position from the fixing belt module 51 (the fixing belt 56). Namely, as shown in FIG. 4, and FIG. 7 to FIG. 10, a drive mechanism 170 that rotates the press roll 58, separated from the fixing belt module 51 (the fixing belt 56), is provided below one outside direction (the rear side) in the axial direction of the press roll 58.

The drive mechanism 170 transmits rotational drive force from the fixing belt 56 (the heater roll 52) to the press roll 58 when the press roll 58 has been separated from the fixing belt 56 by the contact and separation mechanism 160. Further, the drive mechanism 170 is configured so as to block rotational drive force from the fixing belt 56 (the heater roll 52) to the press roll 58 when the press roll 58 is in press-contact with the fixing belt 56.

Specifically, the drive mechanism 170 includes a rotatably supported bracket 172 having a lower end portion (first end portion) formed as a fulcrum 172A. A transmission gear 174, which meshes with a drive gear 156 rotating together with the heater roll 52, is rotatably supported at an upper end portion (second end portion) of the bracket 172. Note that the drive gear 156 that meshes with the transmission gear 174 is attached to a circular shape concentric to the gear 154 at one end side (the rear side) in the axial direction of the heater roll 52 (see FIG. 4).

Figure 8:
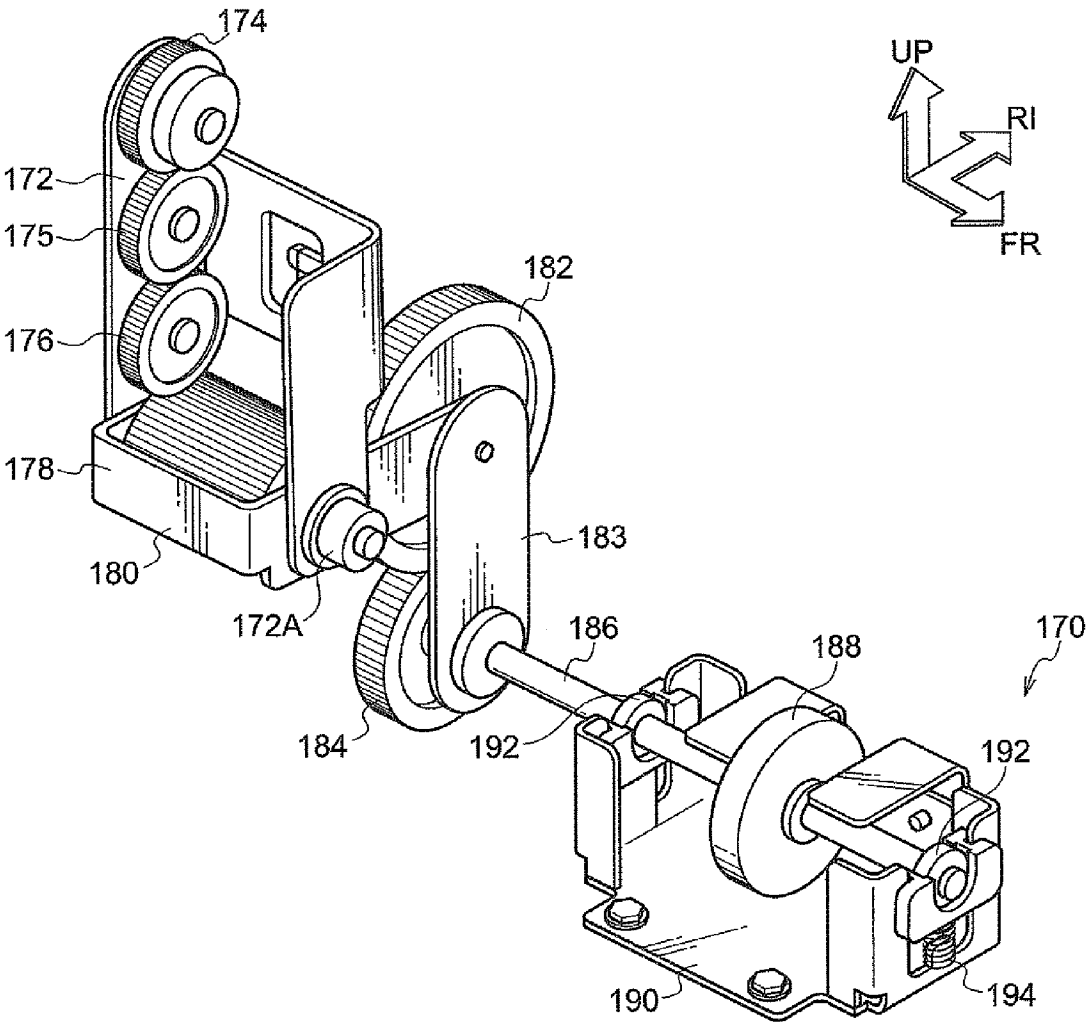
FIG. 8 is a schematic perspective view showing a drive mechanism according to the present exemplary embodiment.

Further, as shown in FIG. 8, an intermediate gear 175 that meshes with the transmission gear 174, and an intermediate gear 176 that meshes with the intermediate gear 175, are respectively rotatably supported by the bracket 172. Further, a roll gear 178, long in the axial direction and meshing with the intermediate gear 176, is rotatably supported at a lower end portion of the bracket 172. In other words, the bracket 172 is rotatable with the fulcrum 172A at the position where the roll gear 178 is rotatably supported.

Further, a large gear 182, rotatably supported by a bracket 180 fixed to the bracket 172, meshes with the roll gear 178. A small gear 184, rotatably supported by a bracket 183 fixed to the bracket 180, meshes with the large gear 182. One end portion of a rotation shaft 186, rotatably supported by an accommodating member 190, described below, is fixed to the small gear 184. A rubber roll 188, serving as an example of a rotation member, makes frictional contact with the press roll 58 when in the separated position and is fixed to a portion at the other end side of the rotation shaft 186.

Consequently, configuration is made such that the rubber roll 188 rotates, from the transmission gear 174 meshed with the drive gear 156, via the intermediate gear 175, the intermediate gear 176, the roll gear 178, the large gear 182, the small gear 184, and the rotation shaft 186. The intermediate gear 175, the intermediate gear 176, the roll gear 178, the large gear 182, the small gear 184, and the rotation shaft 186 are configured as an example of a transmission mechanism.

Further, the rubber roll 188 is rotatably accommodated in the accommodating member 190. Namely, a pair of ring shaped members 192 resiliently supported from below by coil springs 194, serving as examples of biasing means, are disposed at each respective end portion in the front-rear direction of the accommodating member 190 (the axial direction of the rotation shaft 186) so as to be movable in upward and downward directions. The rotation shaft 186 of the rubber roll 188 is inserted through the ring shaped members 192 and is rotatably supported thereby.

Further, a coil spring 196, serving as an example of a resilient member, is provided extending between a rotation shaft 182A of the large gear 182 and the bracket 172. The bracket 172 is constantly biased by a coil spring, not shown in the figures, serving as an example of biasing means, so as to rotate about the fulcrum 172A towards separation of the transmission gear 174 from the drive gear 156 (the direction of arrow F shown in FIG. 9).

Figure 10:
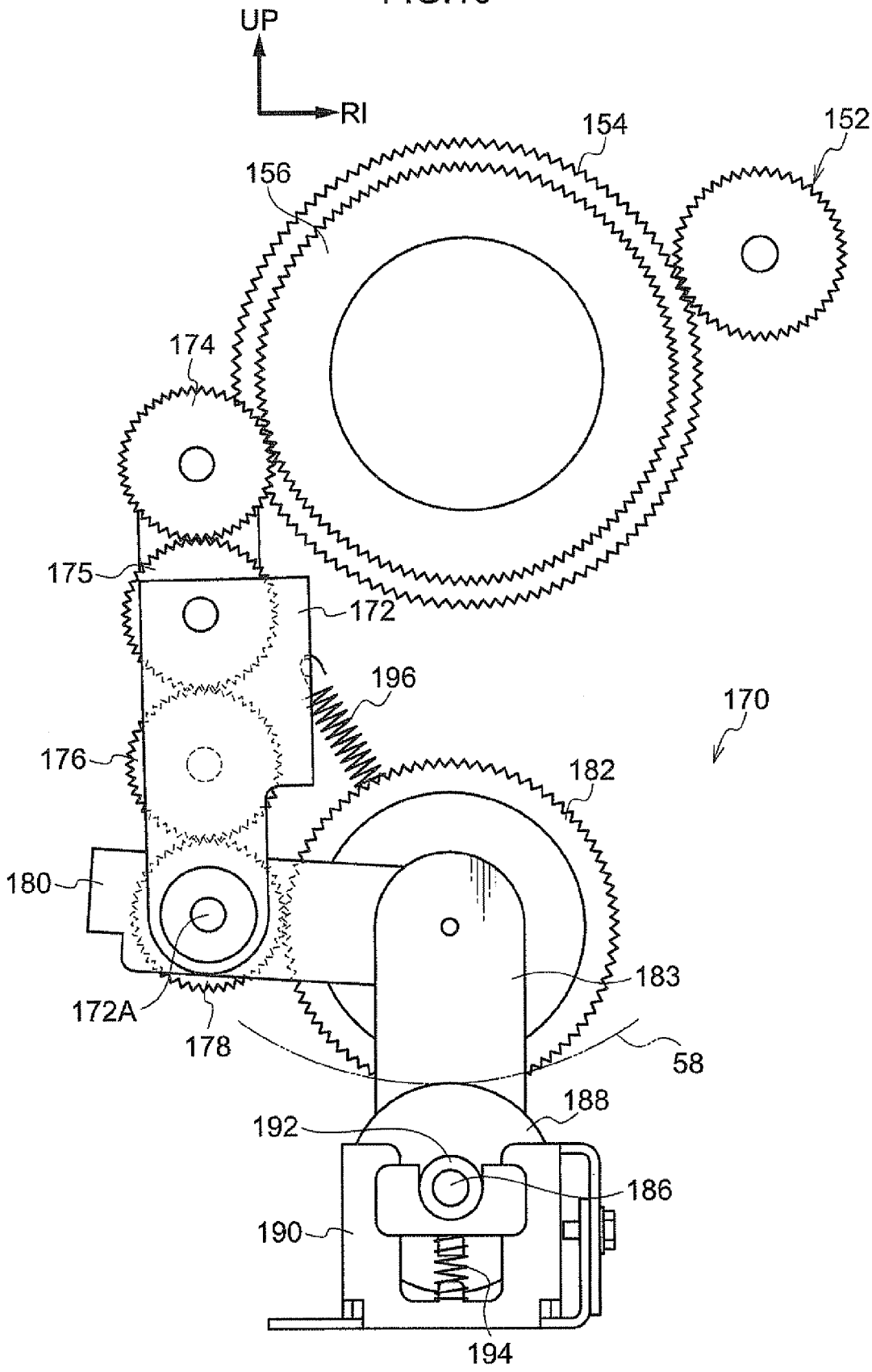
FIG. 10 is a schematic configuration diagram showing a drive mechanism when the press roll is separated by the contact and separation mechanism.

Consequently, when the press roll 58 is lowered to the separated position by the contact and separation mechanism 160 and the surface portion 58C thereof contacts the rubber roll 188, as shown in FIG. 10, the rubber roll 188 is lowered against the biasing force of the coil springs 194 by the weight of the press roll 58, so as to lower the rotation shaft 186, the small gear 184, and the large gear 182.

Figure 9:
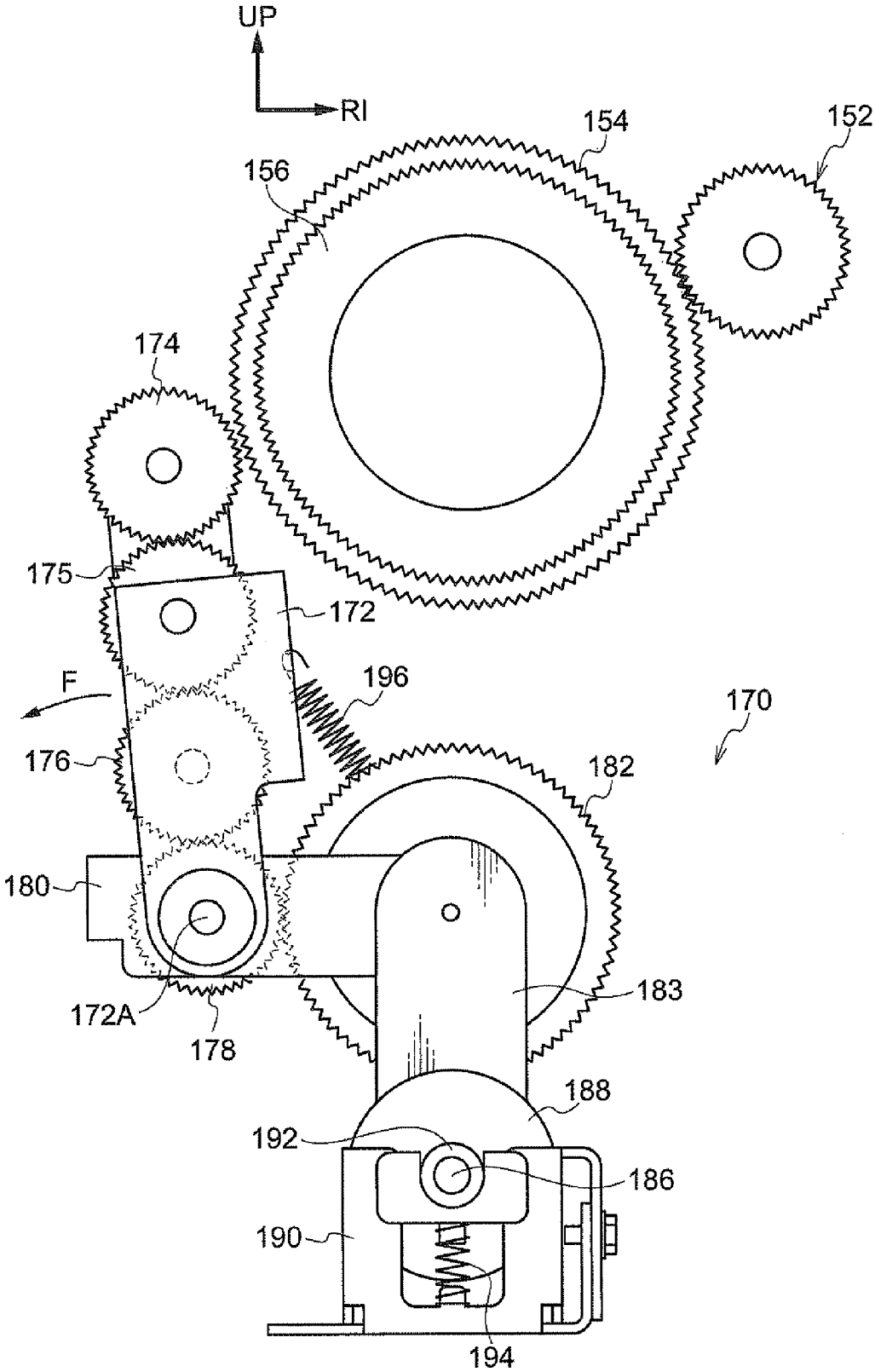
FIG. 9 is a schematic configuration diagram showing a drive mechanism when the press roll is in press-contact due to the contact and separation mechanism.

Since the coil spring 196 is provided extending between a rotation shaft 182A of the large gear 182 and the bracket 172, the bracket 172 is pulled by the coil spring 196, and rotates about the fulcrum 172A in the opposite direction to that of arrow F shown in FIG. 9, such that the transmission gear 174 meshes with the drive gear 156. Due thereto, configuration is made such that the rotational drive force from the drive gear 156 is transmitted to the rubber roll 188, and the press roll 58 is rotated by the rubber roll 188.

However, when the press roll 58 is raised to the press-contact position by the contact and separation mechanism 160, and the surface portion 58C separates from the rubber roll 188, as shown in FIG. 9, the rotation shaft 186, the small gear 184, and the large gear 182 are raised by biasing force of the coil springs 194, such that the bracket 172 rotates about the fulcrum 172A in the direction of arrow F shown in FIG. 9, due to biasing force from the non-illustrated coil spring. Due thereto, configuration is made such that meshing of the transmission gear 174 with the drive gear 156 is released, and rotational drive force is no longer transmitted to the rubber roll 188 (is blocked).

Next, explanation follows regarding operation, in the fixing section 50 configured as above, of the press roll 58 when on print standby. During print standby, when image forming is not being performed, the fixing belt 56 of the fixing belt module 51 moves with circulation at a slower speed than the movement speed during printing. However, in order to make the press roll 58 standby at a different (lower) temperature to that of the fixing belt module 51 (the fixing belt 56), the press roll 58 is separated from the fixing belt module 51 (the fixing belt 56) by the contact and separation mechanism 160.

Namely, the rotation shaft 162 is rotated by the drive motor 168, and each of the cam plates 164 is rotated in the opposite direction to the direction of arrow D. Then, the press roll 58 lowers, while the rotation shaft 158 is being supported by each of the support plates 140, and the surface portion 58C contacts the rubber roll 188. The surface portion 58C of the press roll 58 contacts the rubber roll 188, and the rubber roll 188 is lowered under the weight of the press roll 58, against the biasing force of the coil springs 194.

When the rubber roll 188 is lowered against the biasing force of the coil springs 194, the small gear 184 and the large gear 182 are also lowered via the rotation shaft 186. The bracket 172 is then pulled by the coil spring 196 extending between the bracket 172 and the rotation shaft 182A of the large gear 182, and the bracket 172 rotates about the fulcrum 172A in the opposite direction to the direction of arrow F shown in FIG. 9, against the biasing force of the non-illustrated coil spring.

When the bracket 172 rotates in the opposite direction to the direction of arrow F shown in FIG. 9, the transmission gear 174 rotatably supported by the bracket 172 meshes with the drive gear 156 provided to the heater roll 52 being rotatably driven by the drive motor 150. Due thereto, the rotational drive force from the drive gear 156 is transmitted to the rotation shaft 186, via the transmission gear 174, the intermediate gear 175, the intermediate gear 176, the roll gear 178, the large gear 182, and the small gear 184, and the rubber roll 188 fixed to the rotation shaft 186 is rotated by this rotational drive force.

Since the rubber roll 188 and the surface portion 58C of the press roll 58 contact with friction, when the rubber roll 188 rotates, the press roll 58 in contact therewith, undergoes driven rotation. Consequently, during print standby, when image forming is not being performed, the press roll 58 rotates (idles), and localized raising of the surface temperature of the press roll 58 at locations facing the fixing belt module 51 (the fixing belt 56) is suppressed. Thereby, occurrences of density defects and image defects in toner images fixed to the recording paper P, are suppressed or prevented. Furthermore, the requirement is removed for separate additional provision of a drive source for rotational driving of the press roll separated from the heater roll.

Further, at such a time, the transmission gear 174 is meshed with the drive gear 156 due to the bracket 172 being pulled by the coil spring 196 extending between the rotation shaft 182A of the large gear 182 and the bracket 172, and the transmission gear 174 is suppressed, or prevented, from meshing with the drive gear 156 with excessive force due to the resiliency of the coil spring 196. Consequently, abrasion of the transmission gear 174 and the drive gear 156 is suppressed.

However, during printing, when image forming is being performed, the press roll 58 press contacts the fixing belt module 51 (the fixing belt 56) due to the contact and separation mechanism 160. Namely, the drive motor 168 rotates each of the cam plates 164 in the direction of arrow D, and each of the support plates 140 is raised via each of the support rolls 149. The surface portion 58C of the press roll 58 is then separated from the rubber roll 188, and the transmission gear 174 is separated from the drive gear 156.

In other words, when the press roll 58 separates from the rubber roll 188, since the rubber roll 188 is no longer pressed from above, the rubber roll 188, the rotation shaft 186, the small gear 184, and the large gear 182 rise due to the biasing force of the coil springs 194. Since the bracket 172 is not pulled via the coil spring 196, the bracket 172 rotates about the fulcrum 172A in the direction of arrow F shown in FIG. 9 due to the biasing force of the non-illustrated coil spring.

Meshing of the transmission gear 174 with the drive gear 156 is thereby released, and rotation of the rubber roll 188 stops. In this mariner, since configuration is made such that the rubber roll 188 is not unnecessarily rotated during printing, when image forming is being performed, (when the press roll 58 is in the press-contact position), configuration is made without the lifespan of each of the components configuring the drive mechanism 170 being reduced.

In the above exemplary embodiment, the rubber roll 188 is employed as an example of a rotation member, however the rotation member is not limited to the rubber roll 188, as long as configuration is adopted capable of contact with friction to the surface portion 58C of the press roll 58.

Further, the foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating apparatus comprising:

a press member that undergoes driven rotation by contacting a heating member that rotates, the press member conveying a recording medium while nipping the recording medium between the press member and the heating member;

a contact and separation mechanism that contacts the press member against the heating member and separates the press member away from the heating member;

a drive mechanism that rotationally drives the press member when the press member is separated from the heating member by the contact and separation mechanism, wherein the drive mechanism:

transmits a rotational drive force from the heating member to the press member when the press member is separated from the heating member; and blocks the rotational drive force from the heating member from being transmitted to the press member when the press member is in contact with the heating member.

2. The heating apparatus of claim 1, wherein the drive mechanism comprises:

a rotation member that the press member contacts when the press member is separated from the heating member;

a transmission gear that, when the press member is separated from the heating member, meshes with a drive gear rotating together with the heating member; and a transmission mechanism that transmits a rotational drive force from the transmission gear to the rotation member.

3. The heating apparatus of claim 2, wherein the drive mechanism further comprises:

a bracket that rotatably supports the transmission gear; and a coil spring that extends between the transmission mechanism and the bracket and suppresses meshing pressure of the transmission gear to the drive gear.

4. A heating apparatus comprising:

a press member that undergoes driven rotation by contacting a heating member that rotates, the press member conveying a recording medium while nipping the recording medium between the press member and the heating member;

a contact and separation mechanism that contacts the press member against the heating member and separates the press member away from the heating member;

a drive mechanism that rotationally drives the press member when the press member is separated from the heating member by the contact and separation mechanism, wherein the drive mechanism includes:

a rotation member that the press member contacts when the press member is separated from the heating member;

a transmission gear that, when the press member is separated from the heating member, meshes with a drive gear rotating together with the heating member; and a transmission mechanism that transmits a rotational drive force from the transmission gear to the rotation member.

5. The heating apparatus of claim 4, further comprising:

a bracket that rotatably supports the transmission gear;

a coil spring that extends between the transmission mechanism and the bracket and suppresses meshing pressure of the transmission gear to the drive gear.

6. An image forming apparatus comprising:

an image forming section that forms an image on a recording medium; and a heating apparatus that heats the recording medium on which the image is formed, wherein the heating apparatus includes:

a press member that undergoes driven rotation by contacting a heating member that rotates, the press member conveying the recording medium while nipping the recording medium between the press member and the heating member;

a contact and separation mechanism that contacts the press member against the heating member and separates the press member away from the heating member; and a drive mechanism that rotationally drives the press member when the press member is separated from the heating member by the contact and separation mechanism, and wherein the drive mechanism:

transmits a rotational drive force from the heating member to the press member when the press member is separated from the heating member; and blocks the rotational drive force from the heating member from being transmitted to the press member when the press member is in contact with the heating member.

7. An image forming apparatus comprising:

an image forming section that forms an image on a recording medium; and a heating apparatus that heats the recording medium on which the image is formed, wherein the heating apparatus includes:

a press member that undergoes driven rotation by contacting a heating member that rotates, the press member conveying the recording medium while nipping the recording medium between the press member and the heating member;

a contact and separation mechanism that contacts the press member against the heating member and separates the press member away from the heating member; and a drive mechanism that rotationally drives the press member when the press member is separated from the heating member by the contact and separation mechanism, and wherein the drive mechanism includes:

a rotation member that the press member contacts when the press member is separated from the heating member;

a transmission gear that, when the press member is separated from the heating member, meshes with a drive gear rotating together with the heating member; and a transmission mechanism that transmits a rotational drive force from the transmission gear to the rotation member.

* * * * *